US008168015B2

(12) United States Patent
Doty

(10) Patent No.: US 8,168,015 B2
(45) Date of Patent: May 1, 2012

(54) DIRECT QUENCH HEAT TREATMENT FOR ALUMINUM ALLOY CASTINGS

(75) Inventor: Herbert W. Doty, Amherst, NH (US)

(73) Assignee: GM Global Technology Operations LLC, Detroit, MI (US)

( * ) Notice: Subject to any disclaimer, the term of this patent is extended or adjusted under 35 U.S.C. 154(b) by 835 days.

(21) Appl. No.: 12/256,659

(22) Filed: Oct. 23, 2008

(65) Prior Publication Data

US 2010/0101691 A1 Apr. 29, 2010

(51) Int. Cl.
*C22F 1/04* (2006.01)

(52) U.S. Cl. ..... 148/698; 148/700

(58) Field of Classification Search ..... None
See application file for complete search history.

(56) References Cited

U.S. PATENT DOCUMENTS 3,716,355 A * 2/1973 Wikle et al. ..... 148/417
4,488,913 A 12/1984 Ferton
5,226,983 A * 7/1993 Skinner et al. ..... 148/549
5,571,349 A * 11/1996 Nakazawa et al. ..... 148/690
5,865,911 A * 2/1999 Miyasato et al. ..... 148/439
7,025,839 B2 * 4/2006 Lumley et al. ..... 148/698
2004/0140025 A1 7/2004 Kamat et al.
2005/0236075 A1 * 10/2005 Gheorghe et al. ..... 148/550
2008/0000561 A1 * 1/2008 Ikuno et al. ..... 148/701

FOREIGN PATENT DOCUMENTS

CN 101027419 A 8/2007
DE 60023753 T2 8/2006

* cited by examiner

*Primary Examiner* — George Wyszomierski
(74) *Attorney, Agent, or Firm* — Dinsmore & Shohl LLP

(57) ABSTRACT

A heat treatment method for the direct quench of aluminum alloy castings is presented. An aluminum alloy casting can be heated to the solutionizing temperature. The temperature can be maintained for a period of time sufficient to dissolve the hardening elements into the aluminum solid solution and affect any morphological changes to non-soluble phases, such as speriodization of the eutectic silicon phase. After solutionizing, the aluminum alloy casting can be quenched. The aluminum alloy casting can be rapidly cooled from the solutionizing temperature directly to the aging temperature, eliminating the room temperature hold of a conventional process. Thereby, the process can reduce process steps and equipment, can improve throughput, and can eliminate some waste heat. Further, the process can reduce residual stress and can provide a potential to form new precipitates. Direct quench can also be used with the sequential aging of aluminum casting alloys.

11 Claims, 8 Drawing Sheets

DIRECT QUENCH HEAT TREATMENT FOR ALUMINUM ALLOY CASTINGS

BACKGROUND

The present disclosure generally relates to heat treatment for age-hardenable aluminum casting alloys and, in particular, relates to heat treatment for aluminum casting alloys by direct quenching from solution treatment to the age temperature.

Aluminum silicon alloy castings are typically produced in high volume for diverse applications. In many of these applications, for example cylinder blocks and heads, transmission castings, and the like, the castings may be quite complex. To obtain adequate physical properties such as tensile strength, elongation, and hardness, aluminum silicon castings are generally subjected to a heat treatment.

The most popular Al—Si casting alloys (e.g. 319, 356, 390) are strengthened through the mechanism described as age hardening or precipitation strengthening. The process usually consists of three steps; first, the alloying elements are dissolved into the aluminum solid solution at an elevated temperature. This step is called the solution treatment and is usually performed as a separate operation from the casting process. After solidification, the casting is removed from the mold and then placed in a separate furnace to be reheated to a temperature just below the solidus and held for a period of time sufficient to dissolve precipitates and saturate the a aluminum phase with solute atoms (usually copper (Cu) and/or magnesium (Mg)). In addition, some spheroidization of the insoluble particles (such as silicon) will accompany "solutionizing."

Following solutionizing, the casting is rapidly cooled during the second step of the precipitation strengthening process, termed "quenching." The quench must be rapid enough to restrict diffusion and prevent the solute atoms from precipitating out of solution. A requirement of effective solute elements is that the maximum solubility in aluminum must increase with temperature, so that when the temperature is rapidly lowered, the aluminum will contain more than the equilibrium solute content and become "super-saturated." The super-saturated state is a non-equilibrium state. Since the super-saturated aluminum composition contains more than ten times less solute atoms than the precipitate, solute atoms must cluster together to form regions of higher solute concentration and leave other areas of reduced solute concentration before a precipitate can form.

The third step is the aging step. If performed at room temperature, the aging step is called natural aging. If performed at elevated temperature, the aging step is known as artificial aging. The difference between the equilibrium solute concentration in solution at the solution temperature and the equilibrium solute concentration in solution at the aging temperature provides the driving force for the precipitation reaction. The lower the aging temperature, the higher is this difference and therefore the higher is the driving force. Conversely, the lower the temperature, the lower is the atomic mobility.

Thus, the precipitation reaction is governed by the trade-off between the compositional driving force against the temperature-controlled atomic mobility. Some precipitation occurs even at room temperature. At low temperature, the compositional driving force is high, but since the atomic mobility is low, the diffusion of solute atoms is slow and therefore the precipitation reaction is sluggish. At higher temperatures, the atomic movement is amplified making cluster-formation more rapid, but the compositional driving force is lower, resulting in a lower quantity of precipitate forming.

The choice of aging temperature in conventional heat treatment is a trade-off between reaction rate and the total amount of precipitate formed. The hardness and strength of the component is strongly controlled by the amount of precipitate formed. During aging, the casting is reheated to an intermediate temperature to nucleate the strengthening precipitates. The precipitation reaction itself is a multi-step process, causing the strength and hardness of the casting to rise with time and temperature through some peak hardness value, and then decrease again. When the aging temperature is increased, peak hardness is obtained in a shorter time, but at some expense to the level of peak hardness. Thus, there is an optimal combination of temperature and time resulting in an optimum compromise between peak strength and process time constraints.

Control of each of the above steps is vitally important to achieving the combination of strength and ductility for the particular service application. Some castings are purposely aged at higher temperatures or for longer times to obtain a condition past peak hardness. This "overaged" condition exhibits a lower tensile strength than the peak aged condition, but the increase in tensile elongation (damage tolerance) and dimensional stability can be more important than strength in many applications.

The precipitation reaction involves a diffusion-controlled agglomeration of atom clusters to form zones rich in solute. At a later stage, a discrete phase precipitates from this zone. This clustering and precipitation causes strength to increase by the increase in localized lattice strain. Still later, the precipitates grow in size until the total system energy can be decreased by formation of an interface. At this point, the particle becomes an incoherent phase and the lattice strain decreases significantly with an accompanying drop-off in hardness and tensile strength. The precipitation of the particles is also accompanied by changes to the physical dimensions of the casting with time at temperature. Therefore, for applications with critical dimensional tolerances, the casting is heat treated past the peak hardness to the point where most of the dimensional change has occurred and then it is machined to the required dimensions.

The conventional heat treatment of aluminum castings is an energy- and capital-intensive process that can involve up to two days or longer of in-process inventory at any given time.

The precipitation process is driven by the balancing of compositional driving force against the atomic mobility since each are affected by the temperature in the opposite direction. As the precipitates begin to form, the hardness and strength increase with time at temperature and the ductility decreases due to an increase in lattice strain energy created by the atomic spacing mismatch between the precipitate and the matrix.

As the precipitates grow, the local strain at the precipitate-matrix interface increases until it reaches a maximum at which the system energy can be reduced by breaking the bonds between the precipitate and the matrix, forming a phase boundary. As more precipitates become separated from the matrix by these boundaries (decoherent with the matrix), the mismatch stress are relieved thereby decreasing the hardness and strength and increasing the ductility. Thus, the common observation is that for a given microstructure, the hardness and strength vary inversely with the ductility.

Conventional heat treatments typically require a quench to approximately room temperature using separate quenching equipment before the reheating to the aging temperature. In fact, it is not uncommon for some cylinder blocks to require a 24-hour room temperature hold to reduce residual stress-induced cracking prior to reheating to the aging temperature. Reheating to aging temperature requires a tremendous amount of energy to take the aluminum alloy casting from room temperature to the aging temperature.

Therefore, there is a need for a process that eliminates wasted energy associated with reheating to the aging temperate after a room-temperature quench and that improves throughput by elimination of the room-temperature quench hold. Further, there is a need for a process that eliminates the need for separate equipment to quench to room temperature. Since the quench can be less severe and the temperature interval can be less, the residual stress and cracking tendency can also be substantially reduced.

BRIEF SUMMARY

According to the present disclosure, a heat treating method for the direct quench of aluminum casting alloys is presented. An aluminum alloy casting can be heated to the solutionizing temperature. The temperature can be maintained for a period of time sufficient to dissolve the hardening elements into the aluminum solid solution and affect any morphological changes to non-soluble phases, such as spheriodization of the eutectic silicon phase. After solutionizing, the aluminum alloy casting can be directly quenched by rapidly cooling the aluminum alloy casting from the solutionizing temperature directly to the aging temperature, eliminating the room temperature hold and quenching equipment of a conventional process. Thereby, the process can reduce process steps and equipment, can improve throughput, and can eliminate some waste heat. The process can reduce residual stress and can provide a potential to form new precipitates.

In accordance with one embodiment, the direct quench process can be used in the sequential aging process of heat-treated aluminum alloys.

In accordance with another embodiment, different combinations of mechanical properties in the heat-treated aluminum alloys are enabled.

Accordingly, it is a feature of the embodiments of the present disclosure to obtain mechanical properties in heat treated aluminum alloys with reduced cost, cycle time, negative metallurgical consequences of aluminum alloy casting distortion and residual stress as well as reduced manufacturing process complexity. Other features of the embodiments of the present disclosure will be apparent in light of the description of the disclosure embodied herein.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

In the following detailed description of the embodiments, reference is made to the accompanying drawings that form a part hereof, and in which are shown by way of illustration, and not by way of limitation, specific embodiments in which the disclosure may be practiced. It is to be understood that other embodiments may be utilized and that logical, mechanical and electrical changes may be made without departing from the spirit and scope of the present disclosure.

With the advent of high heat transfer furnaces for heat treating aluminum casting alloys, it can be possible to cool from the solutionizing temperature directly to the aging temperature and to maintain hardening elements in solution, thereby developing the super-saturated solid solution that can be necessary for precipitation strengthening. Better control of the precipitation reaction can now be possible. By varying the quench rate to the age temperature, the precipitation reaction can occur in stages, producing variation of the precipitation sequence and can give rise to a greater latitude in combinations of strength and ductility compared to the traditional solution-quench-age sequence.

In the direct quench heat treatment process, a conventional forced air aging furnace can be replaced with an enhanced thermal conductivity furnace, such as, for example, a fluidized sand bed, to enable the direct quenching of aluminum alloy castings from the solution furnace to the aging furnace, thereby eliminating the intermediate step of quenching to room temperature and with that eliminating the high residual stress and process equipment associated with a conventional quench.

Figure 1:
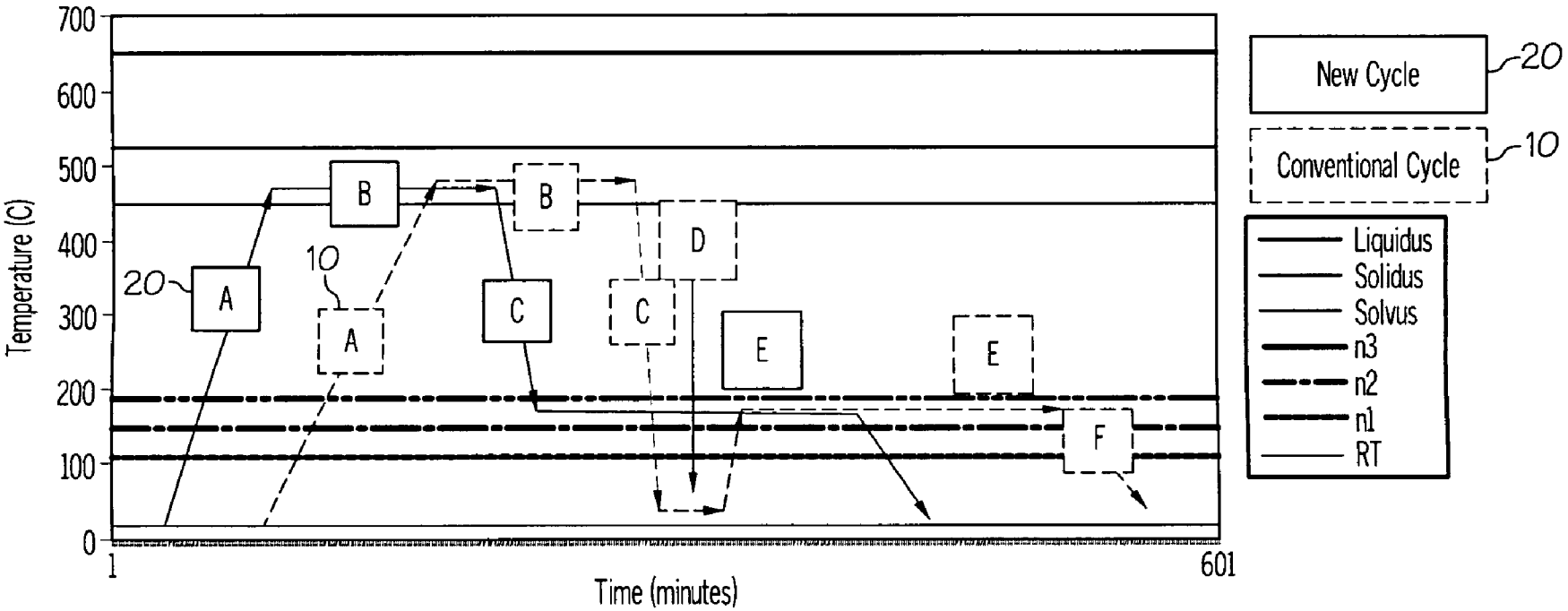
FIG. 1 illustrates a graph comparing a conventional process with a direct quench process according to an embodiment of the present disclosure.

Referring initially to FIG. 1, some of the distinct advantages of directly quenching can be seen by comparing the conventional process cycle shown in FIG. 1 by the dotted line 10 to the new direct quench process shown by the solid line 20. Different stages of the heat treatment process for aluminum alloy castings are shown as horizontal lines. Liquidus is the temperature at which solidification begins and Solidus is the temperature at which solidification is complete. Solvus is the temperature above which the solute is entirely in solution; below this the alloy can exist as a two-phase mixture. Therefore, solution treatment can be performed at a temperature between Solidus and Solvus. Between 100 and 200° C. various stages of the precipitation reaction can occur. This temperature zone is part of the aging regime. For temperatures above Solvus, the precipitates can be dissolving and for temperatures below this line, the precipitates can be growing and coalescing.

In the conventional three-step process, in section A to B, the aluminum alloy castings can be heated to the region between Solidus and Solvus temperatures (i.e., between approximately 450° C. and approximately 525° C.) in order to dissolve alloying elements and spheriodize hard particles, such as, for example, silicon. The aluminum alloy castings are then rapidly cooled, or quenched, in section C, to maintain the alloying elements in solution. In order to reduce residual stress caused by quench, in section D, the aluminum alloy castings can be held at room temperature for various times. The aluminum alloy castings then can be artificially aged by reheating to an intermediate temperature, in section E, to control the precipitation of the strengthen phases. Finally, the aluminum alloy castings can be allowed to cool to room temperature in section F.

In one exemplary embodiment of the direct quench process, an aluminum alloy casting can be heated up to the solutionizing temperature (B) and can be maintained at the solutionizing temperature for a period of time sufficient to dissolve the hardening elements into the aluminum solid solution and affect any morphological changes to non-soluble phases, such as spheriodization of the eutectic silicon phase, if present. In general, the solutionizing temperature can be alloy dependent and can be any temperature between the Solvus temperature and the Solidus temperature. Typically, the higher the solutionizing temperature, the better. Likewise, the period of time that the aluminum alloy casting can be held at the solutionizing temperature can be dependent upon the alloy composition and starting microstructure of the aluminum alloy casting. This period of time can range from about an half hour to about twelve hours. In one exemplary embodiment, the solutionizing temperature can be about 495° C. and the period of time can be approximately four hours.

In one embodiment, the heating rate to the solution temperature can have an effect on the spheriodization rate, and may be varied by aluminum alloy casting thickness, loading the furnace and the heat transfer rate between furnace and aluminum alloy casting.

After solutionizing, the aluminum alloy casting can be direct quenched to the aging temperature. In other words, in the direct quench process, the aluminum alloy casting can be rapidly cooled from the solutionizing temperature directly to the aging temperature, eliminating the room temperature excursion of the conventional process (F). The critical temperature range can be the range of temperatures through which the aluminum alloy casting can be quenched while still preserving the supersaturated solid solution. In one embodiment, the aging temperature can range between about 100° C. to about 260° C. In one exemplary embodiment, the aging temperature can be 190° C. In another exemplary embodiment, the aging temperature can be 240° C. The aluminum alloy casting can be held at the aging temperature for approximately one hour to about twelve hours before being cooled to room temperature. However, for aerospace applications, the aluminum alloy casting can be held at the aging temperature for periods longer than twelve hours before cooling to room temperature.

There are several advantages to elimination of the room temperature quenching step between solutionizing temperature and aging temperature:

Process:

1) Reduced process steps and equipment. No separate quench process step. The quench can proceed when the aluminum alloy casting is placed into the aging furnace. Aging furnace may need to be an enhanced thermal transfer process, such as fluidized sand bed or high-temperature oil, molten salt or thermal fluid.

2) Improved throughput. No hold at room temperature prior to reheating to age temperature. No reheating to age temperature, and 3) Elimination of some waste heat. The heat that must be eliminated from the conventional process to bring the aluminum alloy casting to room temperature must be added back into the aluminum alloy casting to bring it back to the age temperature in a conventional process.

Metallurgical:

1) Reduced residual stress. Reduction in the temperature differential and a reduction in the cooling rate, both work to reduce residual stress, which can reduce the possibility of quench cracks and can improve component fatigue performance and 2) Potential to form new precipitates. The precipitation reaction in conventional heat treat process is based on cooling to room temperature and then reheating. In the direct quench process, this sequence can be broken, allowing higher-temperature precipitates to form first rather than last. Also there can be a potential to reduce the duration of the aging treatment.

The following examples describe testing and results to show the direct quench heat treatment is possible.

It should be noted that the properties of the aluminum alloy castings can be strongly influenced by the as-cast microstructural coarseness, which can be to a large degree controlled by the solidification rate, and the presence, or absence, of defects, such as, for example, porosity. In the examples below, it was assumed that these two factors were held constant and the changes in properties were only due to the effects of the heat treatment.

Example 1

A group of 12 V8 cylinder blocks comprised of 319 aluminum alloy (see Table 1 for composition of the alloy) were sectioned cross-wise through the bore centers into five slices each approximately 5 inches thick. The two end slices of each block were discarded since the geometry and thermal history of these parts can be substantially different from the remaining three slices.

TABLE 1

| 319 Alloy Chemistry | | | | |
|---|---|---|---|---|
| Si | Fe | Cu | Mn | Mg |
| 7 | 0.4 | 3.0 | 0.2 | 0.35 |

The thirty-six slices were randomized and heat treated according to Table 2, two slices per condition.

TABLE 2

| | Solution Treatment (in fluidized sand bed) | Quench | Age Treatment (in fluidized sand bed) |
|---|---|---|---|
| Group 1: Quench in sand | 495° C. - 4 hrs | Sand at 22° C. | 190° C. - 2, 3 and 5 hr |
| | 495° C. - 4 hrs | Sand at 22° C. | 240° C. - 2, 3 and 5 hr |
| Group 2: Quench in water | 495° C. - 4 hrs | Water at 60° C. | 190° C. - 2, 3 and 5 hr |
| | 495° C. - 4 hrs | Water at 60° C. | 240° C. - 2, 3 and 5 hr |

TABLE 2-continued

| | Solution Treatment (in fluidized sand bed) | Quench | Age Treatment (in fluidized sand bed) |
|---|---|---|---|
| Group 3: Direct quench | 495° C. - 4 hrs | Sand at 190° C. | 190° C. - 2, 3 and 5 hr |
| | 495° C. - 4 hrs | Sand at 240° C. | 240° C. - 2, 3 and 5 hr |

Figure 2:
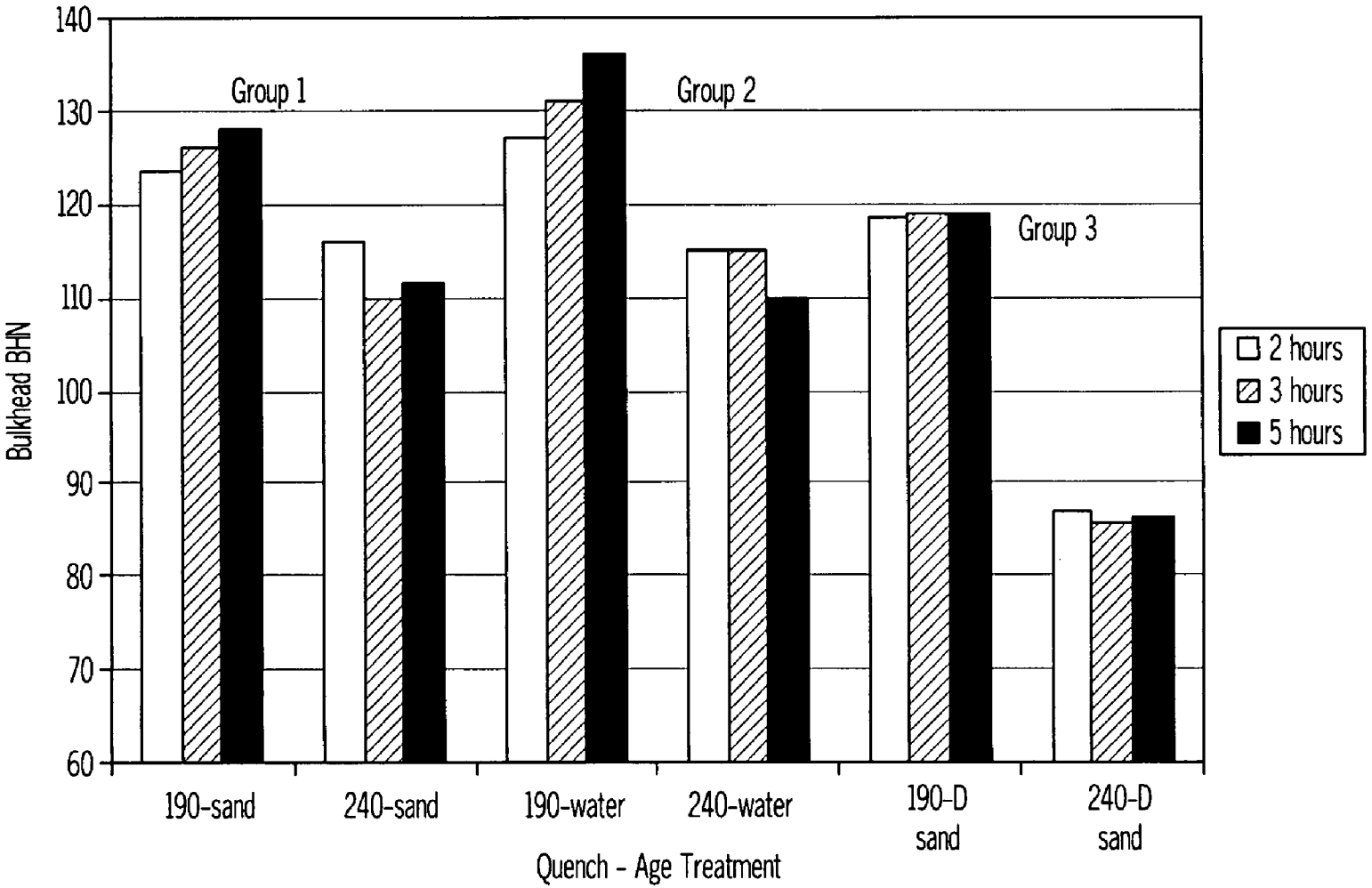
FIG. 2 illustrates the bulkhead hardness experimental results for convention quench and direct quench according to an embodiment of the present disclosure.
Figure 3:
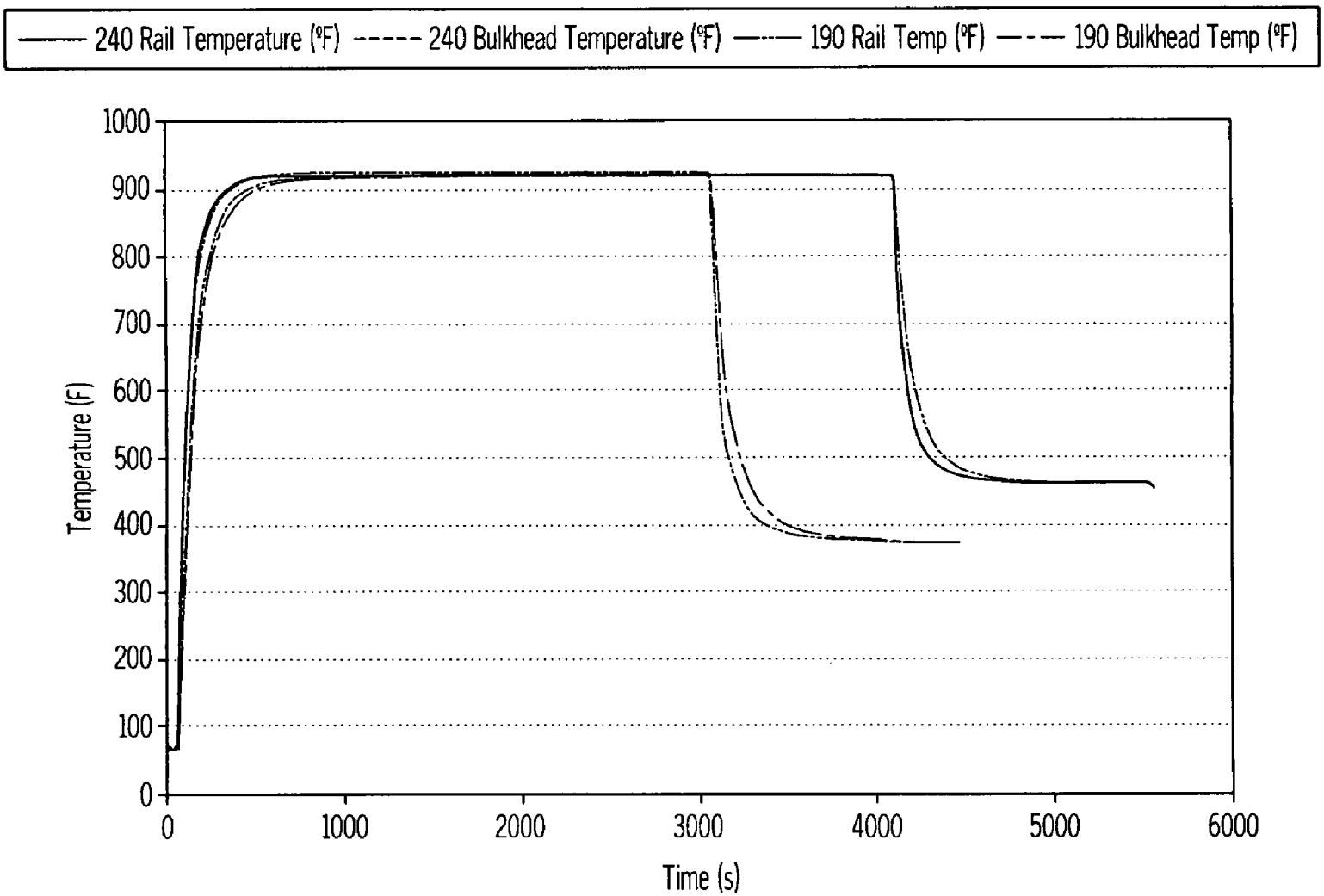
FIG. 3 illustrates the thermal traces from castings treated in direct quench processes at two different temperatures (240° C. and 190° C.) according to an embodiment of the present disclosure.

After heat treatment, specimens were excised from each slice; two from the bulkheads, two from inner bolt bosses and two from the outer bolt bosses. FIGS. 2 and 3 illustrate the Brinell hardness and tensile strength and elongation for each group of heat treatment. An average of four tests were run for each condition. FIG. 3 shows the thermal profile in aluminum alloy castings treated via direct quench (i.e., group 3).

Referring first to FIG. 2, in the conventional treatments (i.e., groups 1 and 2), the hardness can be seen to increase with age time at 190° C. and decrease at 240° C. The effect of quench rate (sand versus water) shows the faster rate of the water quench can result in a higher hardness under similar aging treatment (compare 190-sand to 190-water). The direct quench hardening conversely, shows very little change in hardness with time and seems only to be controlled by the quench rate-age temperature (i.e., group 3, two far right sets of data). The quench rate-age temperature factor cannot be separated into the individual contribution of quench rate and age temperature because the age temperature determines the quench rate to a large degree in this example. From FIG. 3, it can be seen that the quench rate differences are minute. However, it cannot be discounted that important reactions can be taking place in the final 37.8° C. (or 100° F.) of the quench.

In the Table 3, QR1 is the quench rate from the solution temperature to a point 43.3° C. (or 110° F.) from the age temperature and QR2 is the quench rate from 43.3° C. (or 110° F.) to 10° F. above the age temperature (the final 10 degrees are deemed negligible). T2 is the time to cool the last 37.8° C. (or 100° F.).

TABLE 3

Quench rates for 2 direct quench temperatures

| Age T | ΔT | Quench time | Quench rate | QR1 | QR2 | T2 |
|---|---|---|---|---|---|---|
| 190° C. | 305° C. | 642 s | 0.48° C./s | 1.263 | 0.123 | 452 s |
| 240° C. | 255° C. | 508 s | 0.51° C./s | 1.262 | 0.156 | 357 s |
| Standard quench* | 387° C. | 465 s | >0.833° C./s | | | |

*production specification for quench to room temperature

The quench rates in the two examples shown in Table 3 show that the direct quench process can be effective even though cooling rate is slower than conventional heat treat processes (i.e., ~0.5° C./s versus >0.8° C./s). A slower quench rate can reduce aluminum alloy casting distortion and can reduce residual stress, both can be benefits of the current process.

Figure 4:
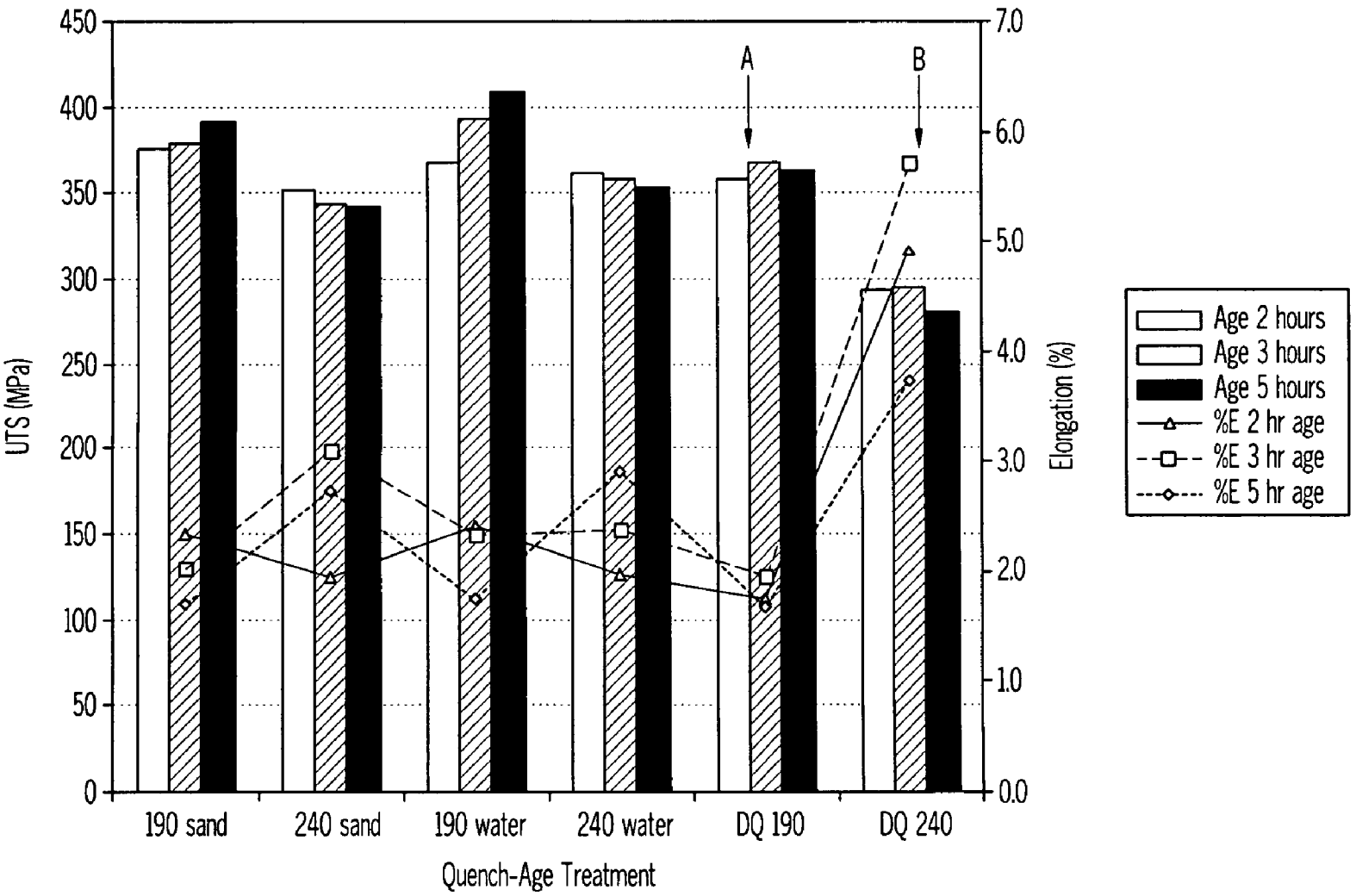
FIG. 4 illustrates tensile strength and elongation experimental results from 319 alloy bars excised from the bulkheads of casting sections heat treated under 6 different conditions according to an embodiment of the present disclosure.

The tensile strength can be summarized by the graph in FIG. 4. The ultimate tensile strength can follow the same pattern as the hardness shown in FIG. 2. However, for the direct quench aluminum alloy castings, the tensile elongation does not follow the conventional pattern of decreasing elongation as the strength increases and then increasing when the strength begins to drop, indicating a more complex reaction. However, the mechanical properties can be similar to the conventional process as seen at point A on the graph. An added benefit of the direct quench process, different combinations or properties can be enabled as seen at point B. Therefore, different combination of mechanical properties in the aluminum alloy castings can be possible in contrast to conventional heat treatment processes, such as the decoupling of tensile strength and hardness.

Example #2

Another series of experiments was conducted in Example #2 to determine the response of different hardening alloy concentrations to direct quench. It has already been shown that the age temperature has a significant effect on the properties produced via the direct quench process and that the hardness and the tensile strength vary with some degree of independence from each other, unlike conventional three-step heat treatment of aluminum alloy. In this series, three alloys, one with 3.7% copper and no magnesium (319 alloy), the second with 2.4% copper and 0.4% Mg (220 alloy) and a third with 3.8% copper and 0.2% Mg (319+Mg alloy) were used (see Table 4 for alloy composition).

TABLE 4

Alloy Chemistry

| | | | | | | |
|---|---|---|---|---|---|---|
| 319 Alloy | Si | Fe | Cu 3.7 | Mg | Mn | Sr |
| 220 Alloy | Si | Fe | Cu 2.4 | Mg 0.4 | Ti | |
| 319 + Mg Alloy | Si | Fe | Cu 3.8 | Mg 0.2 | | |

All alloys were each heat treated by solutionizing at about 495° C. for approximately five hours followed by rapidly cooling (quenching) to the artificial aging temperature (1.2° C./s through critical temperature range). The aluminum alloy castings were then artificially aged by holding at the three different aging temperature (i.e., 170, 190 and 210° C.) for approximately four hours, followed by air cooling to room temperature. The hardness and tensile strength of the three aluminum alloy castings for each condition was measured, as shown in FIG. 5.

Figure 5:
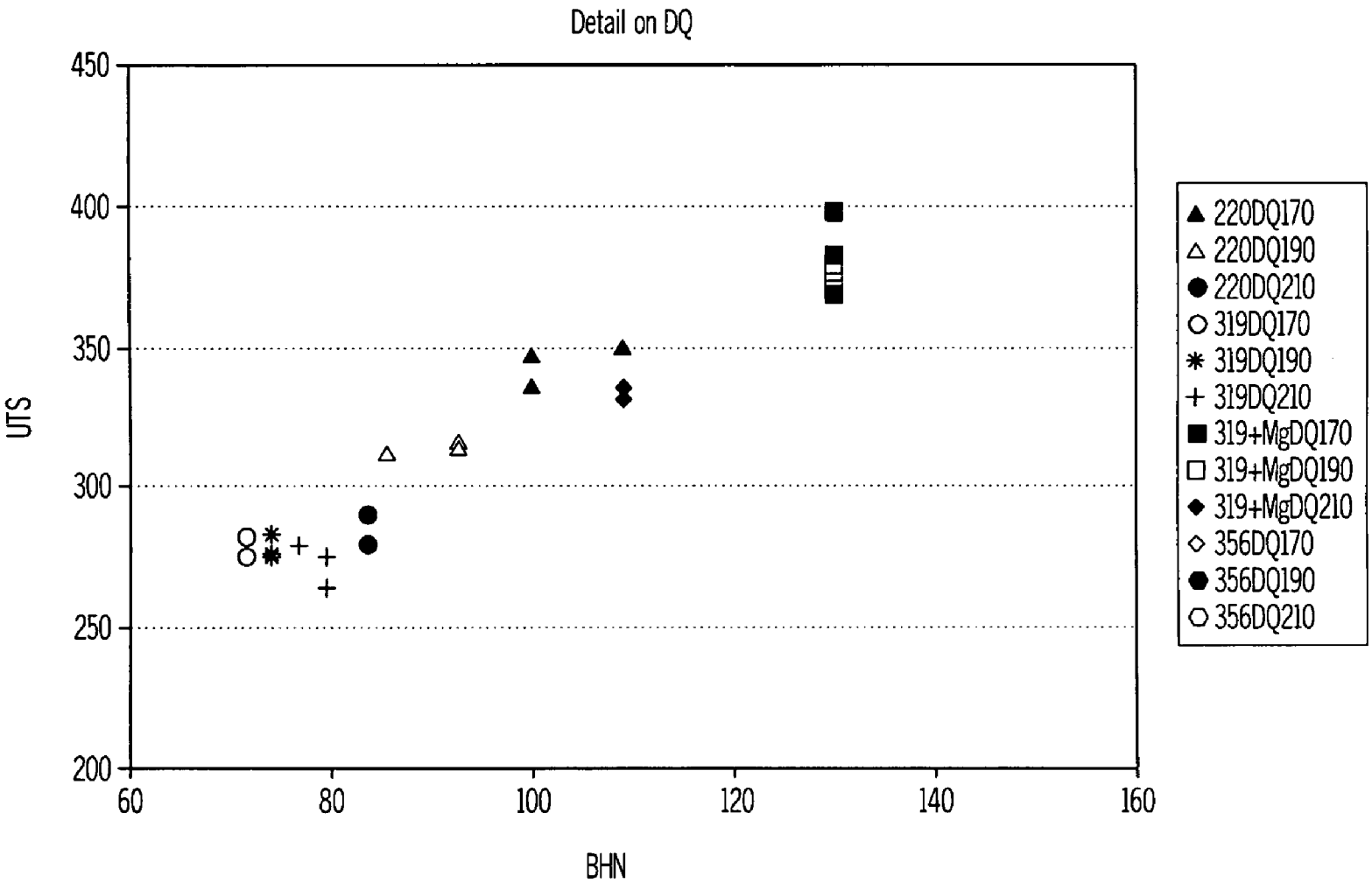
FIG. 5 illustrates tensile strength and elongation experimental results from 319 alloy, 220 alloy and 319+Mg alloy bars direct quenched heat treated according to an embodiment of the present disclosure.

Referring to FIG. 5, the alloys containing both copper and magnesium (220 and 319+Mg) both show a decrease in hardness and tensile strength as the artificial aging temperature is increased. However, the slopes of decrease are different. The higher magnesium alloy (220) loses more strength as compared to hardness of the higher copper/lower magnesium alloy (319+Mg). The magnesium-free alloy (319) conversely shows no effect of age temperature on tensile strength and the opposite trend with hardness compared to the Mg-containing alloys (220 and 319+Mg).

Thus it is found that further de-coupling of the hardness from the tensile strength can be garnered by the interactive manipulation of the alloy composition and the direct quench heat treatment parameters.

Additionally, the direct quench heat treatment process can be used with the sequential aging of aluminum silicon casting alloys as disclosed in the pending U.S. patent application Ser.

No. 12/136,257, filed on Jun. 10, 2008, which is herein incorporated by reference in its entirety.

Example #3

Two-Temperature Aging Process or Sequential Aging

In this series of experiments, the effect of quenching and quenching rate between thermal treatments in a double-age heat treatment was evaluated. The conventional heat treatment with sequential aging comprises the steps of:

1. solution treatment,
2. quench to room temperature,
3. reheat to the first age treatment,
4. hold,
5. cool to room temperature,
6. heat to second age temperature,
7. hold, and
8. cool to room temperature.

The cooling between aging treatments was varied according to Table 6. Group 1 exercised the direct quench process, thereby essentially combing steps 2 and 3 of the conventional process described above. As-cast grate castings were produced with a small steel chill, giving a microstructure with a dendrite cell size of about 30-40μ. Individual bar sections of 0.75 inch×1.25 inch×4 inch were heat treated (three per condition) as follows. The A356 bars (see Table 5 for the composition of this alloy) were solution treated at 538° C. for 5 hours in a fluidized sand bed and then quenched into water at 60° C. The 319 bars (see Table 5 for the composition of this alloy) were solution treated at 495° C. for 5 hours and quenched into 60° C. water. All bars were stored in a freezer at −17° C. between solution treatment and aging.

TABLE 5

Alloy Chemistry for sequential aging

| | | | | | | |
|---|---|---|---|---|---|---|
| 319 Alloy | Si | Fe | Cu | Mn | Mg | Sr |
| | 6.5 | 0.39 | 3.8 | 0.57 | 0.2 | 0.012 |
| A356 Alloy | Si | Fe | Cu | Mg | Ti | |
| | 7 | 0.1 | 0.01 | 0.34 | 0.14 | |

All test bars were Brinell tested and then machined and tensile tested at room temperature.

TABLE 6

| | Age 1 T | Age 1 t | Q | NA | Age 2 T | Age 2 t | Q |
|---|---|---|---|---|---|---|---|
| Group 1 | 249 C. | 67 min | 182 C. sand | 0 | 182 C. | 6 hr | Air cool |
| Group 2 | 249 C. | 67 min | 32 C. water | 1 hr | 182 C. | 6 hr | Air cool |
| Group 3 | 249 C. | 67 min | 32 C. water | 24 hr | 182 C. | 6 hr | Air cool |
| Group 4 | 249 C. | 67 min | Air cool | 1 hr | 182 C. | 6 hr | Air cool |
| Group 5 | 249 C. | 67 min | Air cool | 24 hr | 182 C. | 6 hr | Air cool |
| Group 6 | 249 C. | 67 min | Air cool | 1 hr | 182 C. | 6 hr | 32 C. water |
| Group 7 | 249 C. | 67 min | Air cool | 24 hr | 182 C. | 6 hr | 32 C. water |
| T6 | 193 C. | 8 hr | Air cool | | | | |
| T7 | 227 C. | 8 hr | Air cool | | | | |
| As-Cast | No heat | treat-ment | | | | | |

Figure 6:
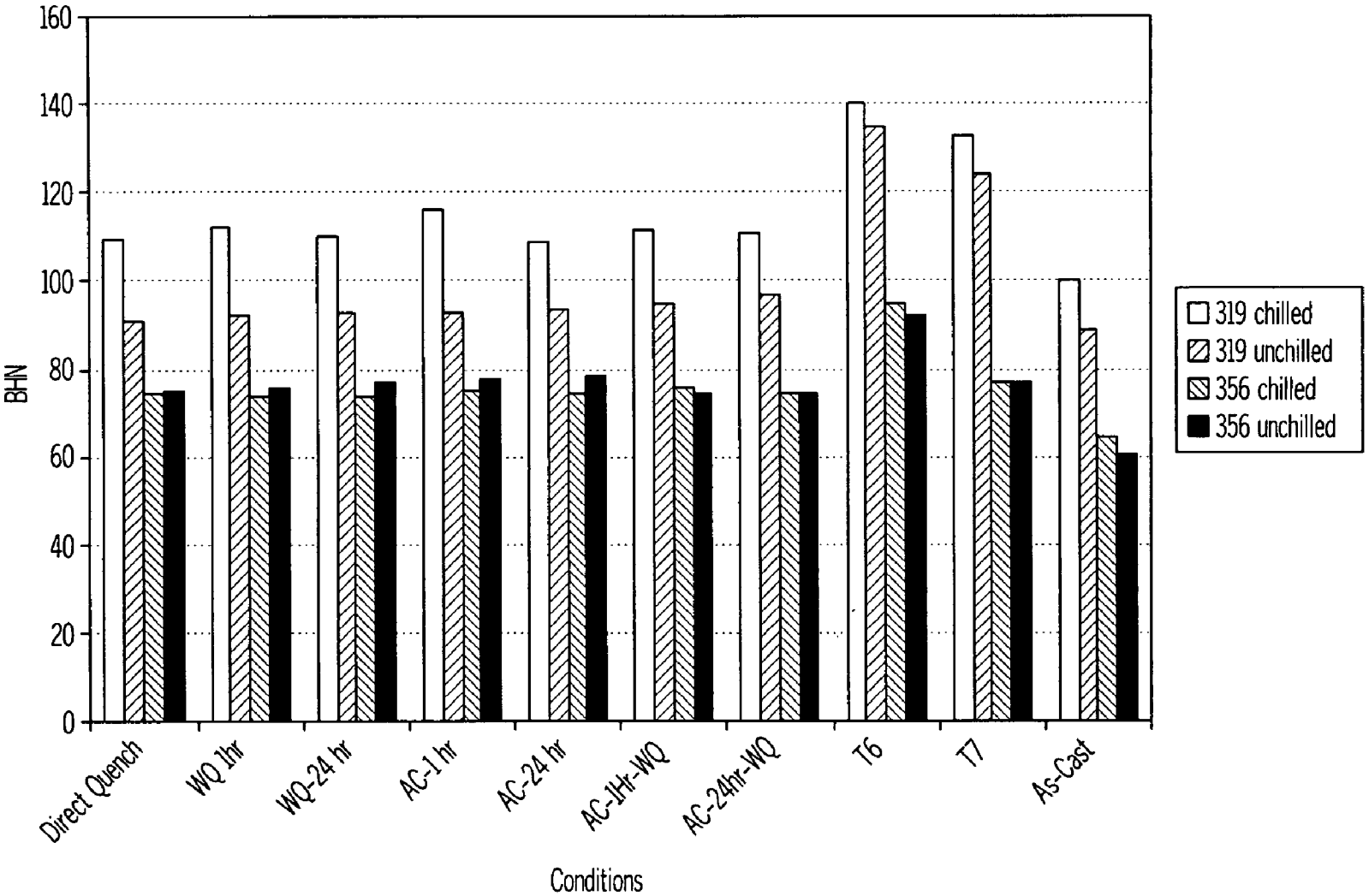
FIG. 6 illustrates hardness experimental results for A356 and 319 heat treated alloy bars according to an embodiment of the present disclosure.
Figure 7:
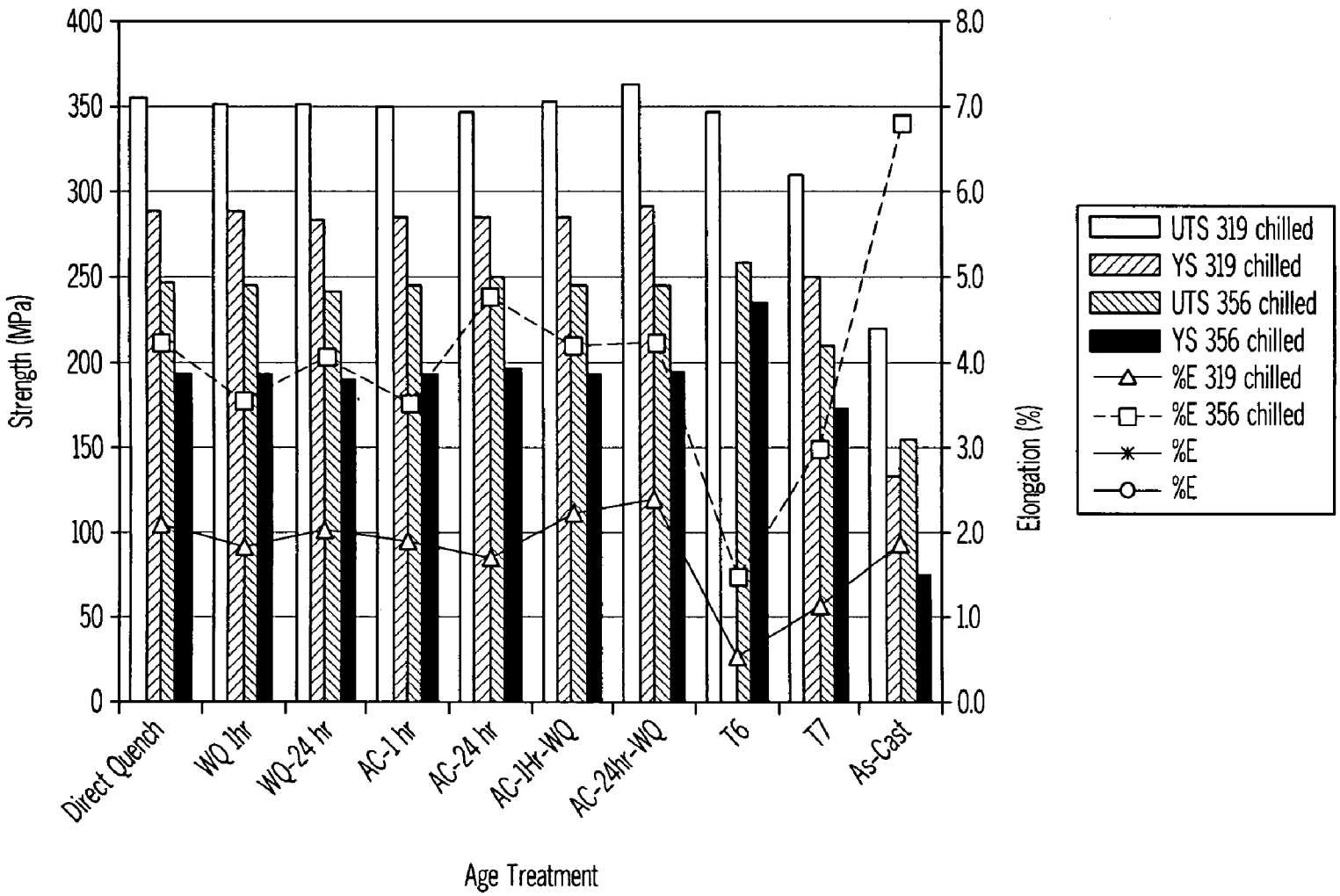
FIG. 7 illustrates tensile experimental results for A356 and 319 heat treated alloy bars according to an embodiment of the present disclosure.

Q - cooling medium
NA - natural age at room temperature
t - time the bars were in the furnace
T - temperature of sand The importance of the data given in FIGS. 6 and 7 for the direct quench can be seen by comparing the first column (Direct Quench) to the following six columns. All of the test bars are similar thermal treatments and it can be seen that no additional benefit for the sequential age treatment can be gained by fully cooling to room temperature between aging treatments. The as-cast and traditional heat treatments, T6 and T7 are shown solely for reference.

Direct quench can be used at several different steps of the sequential aging process. For example, in one exemplary embodiment, the aluminum alloy casting can be solution heat treated to dissolve the alloying elements. The aluminum alloy casting can then be direct quenched to the nucleation temperature. In one exemplary embodiment, the nucleation temperature can be approximately 250° C. The aluminum alloy casting can be maintained and held at the nucleation temperature for a time sufficient to induce nucleation throughout the aluminum alloy casting. In one exemplary embodiment, the time period that is sufficient can be approximately one hour. After this time period, the aluminum alloy casting can be direct quenched to the aging temperature to grow precipitates in the aluminum alloy casting. In one exemplary embodiment, the aging temperature can range from approximately 100° C. to approximately 220° C. and the aluminum alloy casting can be held at aging temperature for approximately six hours. Finally, the aluminum alloy casting can be cooled to room temperature.

In another exemplary embodiment, the aluminum alloy casting can be solution heat treated to dissolve the alloying elements. The aluminum alloy casting can then be direct quenched to the nucleation temperature and can be maintained and held at the nucleation temperature for a time sufficient to induce nucleation throughout the aluminum alloy casting. After this time period, the aluminum alloy casting can be cooled to room temperature. After a set period of time, the aluminum alloy casting can be reheated to an aging temperature to grow precipitates as distinct phase in the aluminum alloy casting. Finally, the aluminum alloy casting can be cooled to room temperature.

In yet another exemplary embodiment, the aluminum alloy casting can be solution heat treated to dissolve the alloying elements. The aluminum alloy casting can then be quenched to room temperature. The aluminum alloy casting can then be reheated to a nucleation temperature and can be maintained at the nucleation temperature for a time sufficient to induce nucleation throughout the aluminum alloy casting. The aluminum alloy casting can then be direct quenched to an aging temperature to grow precipitates as distinct phase in the aluminum alloy casting. Finally, the aluminum alloy casting can be cooled to room temperature.

Figure 8:
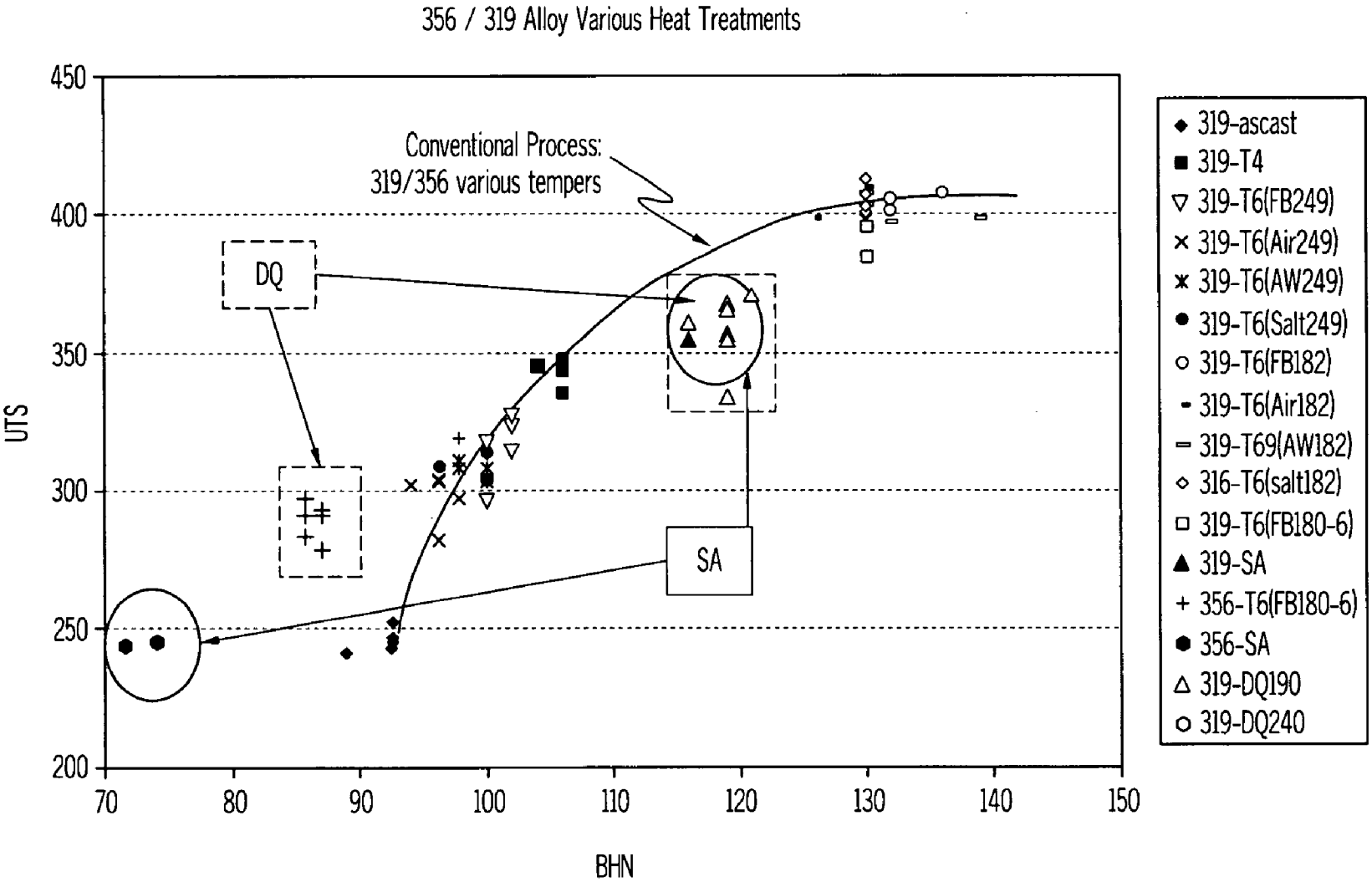
FIG. 8 illustrates the decoupled tensile strength/hardness relationship for A356 and 319 heat treated alloy bars according to an embodiment of the present disclosure.

The improvement of combination of the direct quench process with the Sequential Aging process over the conventional Sequential Aging process can be primarily in process simplification, throughput enhancement and cost reduction. Direct Quench and sequential aging processes can also decouple the conventional tensile strength-hardness relationship as seen in FIG. 8 for 356/319 alloys at various heat treatments.

In summary of the exemplary embodiments of the direct quench process, the process can be used for heat treating aluminum alloys that undergo a strengthening reaction due to the precipitation of hardening phases from a super-saturated solid solution. The selection of cooling rate and aging temperature can have a strong affect on the properties attained. In addition, direct quenching can be utilized to reduce the number of process steps necessary to take advantage of the combination of properties resulting from using the sequential age heat treat process.

It is noted that terms like "preferably," "commonly," and "typically" are not utilized herein to limit the scope of the claimed disclosure or to imply that certain features are critical, essential, or even important to the structure or function of the claimed disclosure. Rather, these terms are merely intended to highlight alternative or additional features that may or may not be utilized in a particular embodiment of the present disclosure.

For the purposes of describing and defining the present disclosure it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the disclosure in detail and by reference to specific embodiments thereof, it will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these preferred aspects of the disclosure.

What is claimed is:

1. A method of heat treating aluminum alloy castings, the method comprising:

heating the aluminum alloy castings to a solutionizing temperature;

quenching the aluminum alloy castings from the solutionizing temperature directly to an aging temperature;

maintaining the aging temperature for a period of time from about one hour to about twelve hours; and cooling the aluminum alloy castings to room temperature.

2. The method of claim 1, wherein the solutionizing temperature is from about 450° C. to about 525° C.

3. The method of claim 1, further comprising, maintaining the solutionizing temperature for a period of from about one-half hour to about twelve hours before quenching to the aging temperature.

4. The method of claim 1, wherein the aging temperature is from about 100° C. to about 260° C.

5. The method of claim 1, wherein the quenching of the aluminum alloy castings to the aging temperature occurs in a fluidized sand bed, high temperature oil, molten salt or a thermal fluid.

6. The method of claim 1, wherein hardness is controlled by quench rate and the aging temperature.

7. A multiple step artificial aging method for an aluminum alloy casting, the method comprising:

solution heat treating the aluminum alloy casting to dissolve alloying elements, followed by quenching directly to a nucleation temperature;

maintaining the aluminum alloy casting at the nucleation temperature and holding at a temperature at least equal to the nucleation temperature for a time sufficient to induce nucleation throughout the aluminum alloy casting;

cooling the aluminum alloy casting to room temperature;

reheating to an aging temperature to grow precipitates as a distinct phase in the aluminum alloy casting; and cooling the aluminum alloy casting to room temperature.

8. The method of claim 7, wherein the nucleation temperature is about 250° C.

9. The method of claim 7, wherein the aluminum alloy casting is maintained at the nucleation temperature for about an hour.

10. The method of claim 7, wherein the aging temperature is from about 100° C. to about 220° C.

11. The method of claim 7, wherein the aluminum alloy casting is held at the aging temperature for about six hours.

* * * * *